United States Patent [19]

Bollinger et al.

[11] 4,155,196

[45] May 22, 1979

[54] PLAY METHOD AND APPARATUS FOR PRODUCING A HEARTBEAT-LIKE SOUND

[75] Inventors: Howard N. Bollinger; Dale I. Goldberg, both of Cincinnati, Ohio

[73] Assignee: General Mills Fun Group, Inc., Minneapolis, Minn.

[21] Appl. No.: 796,082

[22] Filed: May 12, 1977

[51] Int. Cl.[2] ..... A63H 33/26

[52] U.S. Cl. ..... 46/232; 46/117; 46/175 R

[58] Field of Search ..... 46/232, 227, 175 R, 46/117

[56] References Cited

U.S. PATENT DOCUMENTS

| | | | |
|---|---|---|---|
| 2,715,296 | 8/1955 | Pettit | 46/175 R |
| 2,791,765 | 5/1957 | Kahn et al. | 46/232 UX |
| 3,024,568 | 3/1962 | Barnett | 46/232 |
| 3,119,200 | 1/1964 | Curtin et al. | 46/232 |
| 3,232,004 | 2/1966 | Felsher | 46/232 X |
| 3,266,187 | 8/1966 | Felsher | 46/227 X |
| 3,888,233 | 6/1975 | Ware | 46/232 X |

FOREIGN PATENT DOCUMENTS

| | | | |
|---|---|---|---|
| 721432 | 11/1966 | Italy | 46/232 |

*Primary Examiner*—Russell R. Kinsey
*Assistant Examiner*—Mickey Yu
*Attorney, Agent, or Firm*—G. O. Enockson; L. MeRoy Lillehaugen; S. R. Peterson

[57] ABSTRACT

A doll or other toy animal has a permanent magnet concealed where its heart should be. A toy stethoscope includes a probe containing therein a normally open reed switch which is closed to produce a heartbeat-like sound when the probe is near the magnet.

5 Claims, 5 Drawing Figures

PLAY METHOD AND APPARATUS FOR PRODUCING A HEARTBEAT-LIKE SOUND

BACKGROUND OF THE INVENTION

1. Field of the Invention

This invention relates generally to animate-like figures in the form of a doll or toy animal, and pertains more particularly to such a figure having a concealed magnet which causes a simulated heartbeat to be produced by a magnetically responsive toy stethoscope probe.

2. Description of the Prior Art

One patent is known to exist for producing a heartbeat-like sound. U.S. Pat. No. 3,024,568, granted on Mar. 13, 1962 to Harry E. Barnett discloses a toy stethoscope utilizing a pressure sensitive switch which is closed when pressed against an object to energize a circuit causing generation of the simulated heartbeats. While the principal object of the patented toy stethoscope is to encourage its use with a doll, there is nothing that compels that it be so used since the switch would be activated when pressed against any object, such as a table or chair. Even when used with a doll, the switch would be closed when placed on any part of the doll, such as the doll's head or leg. Therefore, there is nothing in the patented arrangement that teaches the child to use the toy stethoscope in the manner that a doctor or nurse would use a real stethoscope, namely placing the stethoscope head or probe where the heart should be found. Since the heartbeat-like sound producing mechanism will be turned on irrespective of what object the pressure sensitive switch is pressed against, it follows that the circuitry will at times be energized inadvertently, such as when the toy stethoscope is not being played with and has been stored with other toys which it can bear against. Obviously, if the switch is closed for any length of time, the battery will be unnecessarily discharged. Also, since coil springs are employed which bias the switch contacts into open position, the stethoscope is rendered more complicated than need be.

SUMMARY OF THE INVENTION

One object of the invention is to provide a toy stethoscope that will be educational and challenging to a child. In this regard, it is an aim of the invention to provide a stethoscope for use with a baby doll or toy animal that will be operated only when the probe of the stethoscope is moved into a position close to where the heart should be. Consequently, the child is encouraged to continue exploring until the proper position has been determined at which moment the child is apprised of his or her success. Stated somewhat differently, no heartbeat sound is produced until the probe of the toy stethoscope has been correctly located, thereby rendering the procedure educationally intriguing.

Another object is to provide a battery operated toy stethoscope in which the life of the battery will be prolonged by reason of the sound producing mechanism being energized only when the toy stethoscope is in actual use and even then only if the child has been successful in determining the proper location of the magnetic heart.

Still further, an object is to provide a stethoscope that will be rugged and not apt to be broken, even when mishandled and mistreated.

Yet another object of the invention is to provide a toy stethoscope that will be simple and relatively inexpensive to manufacture.

Briefly, our invention envisages the placing of a permanent magnet in the general region of where the heart should be, preferably within the chest of a doll or other toy animal. The toy stethoscope for use with the animate-like figure includes a magnetically responsive reed switch having normally open contacts which are closed only when the reed switch is juxtaposed with the magnetic heart. The reed switch, being mounted in the probe of the toy stethoscope, requires that the child exploratorily move the probe until the proper location has been determined. No forceful action is required because operation depends only on the probe, actually the reed switch therein, being influenced by the magnetic field generated by the hidden magnet serving as the "heart". When this situation prevails, the now closed contacts energize a circuit which turns on the sound producing mechanism, the circuit automatically causing a rubber diaphragm, the diaphragm having an armature member thereon in the form of a permanent magnet, to flex first in one direction and subsequently released so that the diaphragm returns to its original or undeflected position, thereby generating a dual or double heartbeat sound, one beat for each direction of diaphragm motion. The sound is conducted through hearing tubes to the ears of the user. Heartbeat sounds are generated only during the interval that the stethoscope probe is in a proximal relation with, and magnetically influenced by, the magnetic heart.

DESCRIPTION OF THE PREFERRED EMBODIMENT

Figure 1:
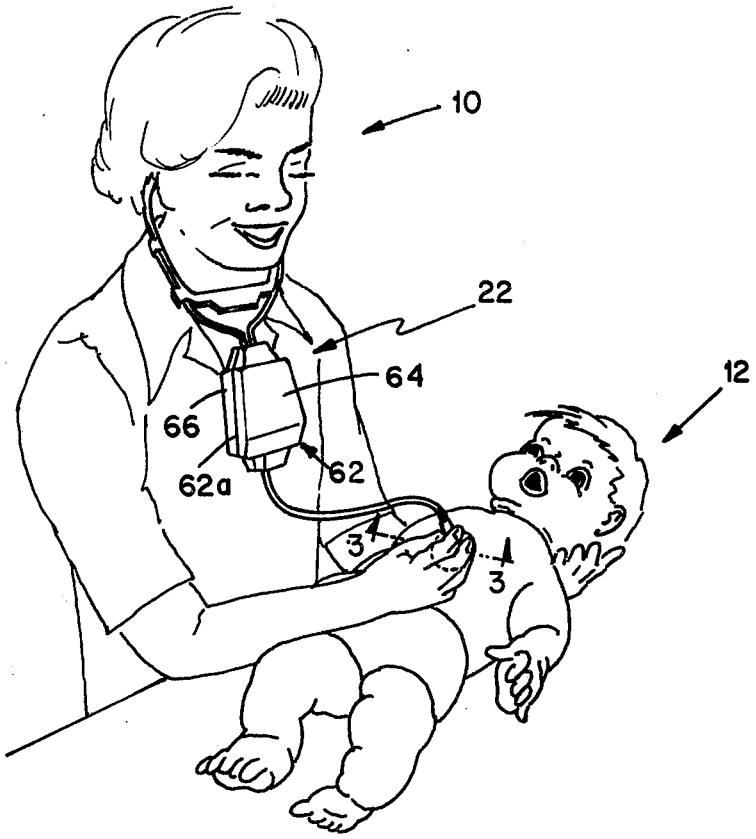
FIG. 1 illustrates a child utilizing our toy stethoscope with a doll having a permanent magnet embedded in its chest.

Reference is first made to FIG. 1 in which a little girl labeled 10 is depicted. Also shown in FIG. 1 is a baby doll denoted generally by the reference numeral 12 having a layer of plastic skin 14, such as vinyl, and filled with a resinous foam material 16, portions of which can be seen in FIG. 3.

Figure 3:
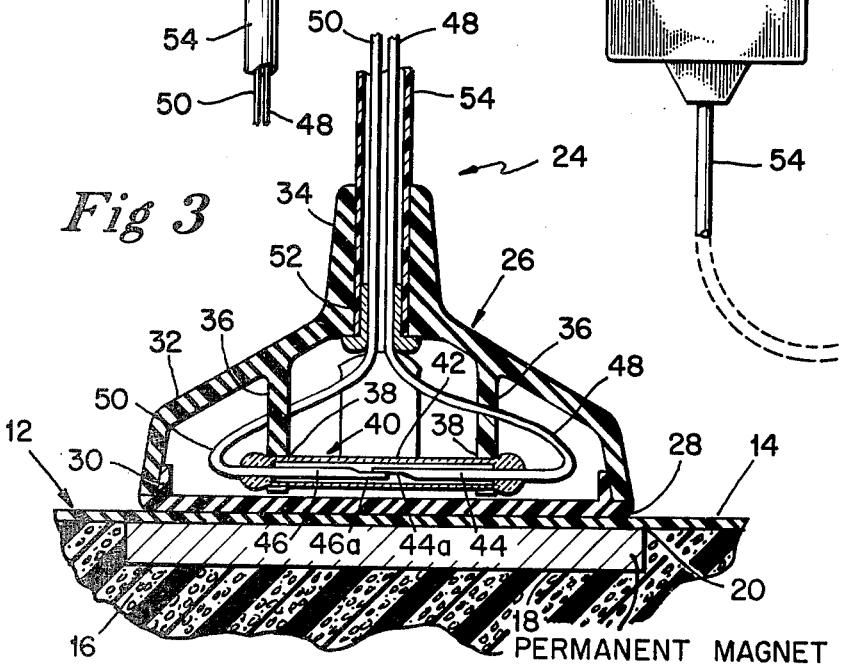
FIG. 3 is a sectional view taken in the direction of line 3—3 of FIG. 1 for the purpose of showing the embedded magnet and the internal construction of the stethoscope probe.

Also, as can be seen from FIG. 3, a permanent magnet 18 in the form of a flat strip or block is retained against the inner surface of the artificial skin 14 at 20, being trapped by adjacent foam material 16. In accordance with our invention, the magnet 18 is located where a live baby's heart would logically be, preferably within the chest of the doll, although it could be in the form of a magnet attached to the outside of the doll and concealed or hidden by the doll's clothing, for example.

While the doll 12 has been illustrated as being in the form of a little baby, it will be understood that the animate-like figure can also be a toy animal, such as a dog or bear. As this description progresses, it will be recognized that our play apparatus will be intriguing to young children. Consequently, the girl 10 would be more interested in the baby doll 12, whereas a small boy would be more apt to prefer the likeness of an animal. The intrigue and educational benefits are derived as a result of finding the "heart" by reason of properly concealing the magnet 18, irrespective of whether it is contained within a baby doll or within a toy animal or hidden from view on the outside.

Figure 2:
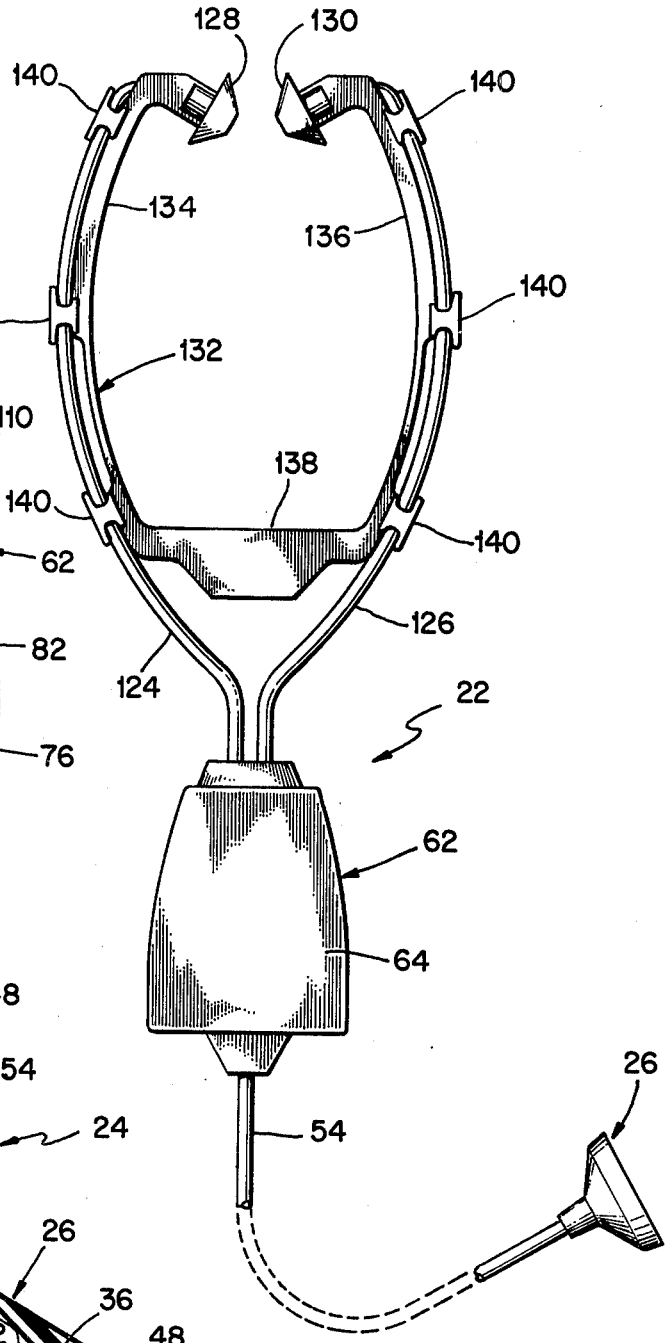
FIG. 2 is a plan view of our stethoscope as it would appear when laying on a flat surface.

A toy stethoscope is denoted generally by the reference numeral 22. Whereas FIG. 1 shows the stethoscope 22 in actual use by the little girl 10, FIG. 2 shows the stethoscope when not in use and laying on a flat surface. The stethoscope 22 includes a pickup probe designated generally by the reference numeral 24. From FIG. 3 it can be seen that the probe 24 is comprised of a two-part plastic housing 26. More specifically, the housing 26 includes a circular disc 28 having an integral flange 30, the disc 28 functioning as a cover for a shell 32 which constitutes the other part of the housing 26. As can best be seen in FIG. 3, the shell 32 is formed with a tubular neck 34. Also, various reinforcing walls can be employed with the shell or partitions, only two of which have been depicted which are identified by the reference numeral 36, each wall 36 having a notch 38 for the purpose explained below.

Playing an important role in the practicing of our invention is a magnetically responsive reed switch 40. The switch 40 includes a tubular glass envelope 42 containing therein two metallic reeds 44, 46. One end of each reed 44 and 46 is hermetically sealed within the ends of the glass envelope 42. However, their free or innermost ends overlap and form normally open contacts **44*a* and 46*a*. The ends of the reeds 44, 46 extending through the ends of the envelope 42 having conductors 48 and 50** attached thereto, the conductors being covered with a suitable insulation.

Extending upwardly into the tubular neck 34 of the shell 32, as can be seen in FIG. 3, is a flanged bushing or tube retainer, the retainer 52 serving to anchor one end of a flexible plastic tube 54 which contains therein the previously mentioned insulated conductors 48 and 50. The flexible tube 54 has at its other end a second tube retainer 56 corresponding to the retainer 52, it being the function of the second tube retainer 56 to anchor the second end of the tube 54 within a plastic bushing or sleeve 58 having a collar 60 thereon.

Denoted generally by the reference numeral 62 is a rigid or impact resistant plastic housing or case composed of shells 64 and 66 interfitted at the line **62*a* (FIG. 1). Whereas the flexible tube 54 terminates within the plastic sleeve or bushing 58, the bushing or sleeve 58 in turn is held captive by appropriately designed portions integral with the shells 64 and 66 which need not be described; all that need be pointed out is that when the shells 64 and 66 are mated with each other at the line 62*a*, the sleeve or bushing 58 is anchored to the case 62**.

Figure 5:
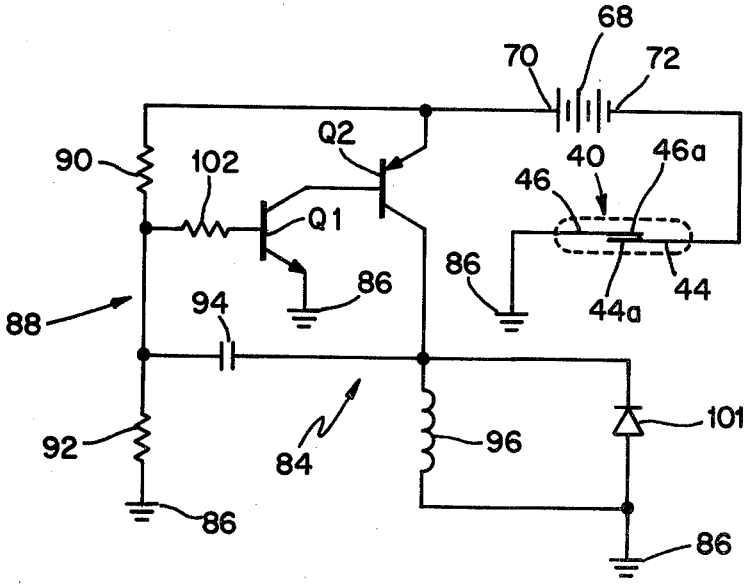
FIG. 5** is a schematic diagram showing the electrical circuit for causing the flexible diaphragm to be repeatedly deflected to produce the heartbeat-like sound.

The case 62 contains a battery 68 (FIGS. 4 and 5) having a positive terminal 70 and a negative terminal 72 (FIG. 5). The shell 66 is configured to form a battery compartment 74 (FIG. 4) and a pair of battery contacts 76 and 78 (FIG. 4) bear against the battery terminals 70 and 72, respectively (not visible in FIG. 4 but shown schematically in FIG. 5). Whereas the earlier-mentioned conductor 48 is soldered directly to the contact 76, the other battery contact 78 has a short length of conductor 80 extending therefrom. The other earlier-mentioned conductor 50 and the conductor 80 lead to a printed circuit board 82 having a circuit 84 thereon.

The circuit 84 is schematically shown in FIG. 5 and constitutes an oscillator or multivibrator. The circuit 84 has several common grounds, all identified by the reference numeral 86 and all connected to the negative terminal 72 of the battery 68. Thus, the conductor 48 extends from the contact 78 which is in engagement with the negative terminal 72 of the battery 68, through the plastic tube 54 to the reed switch 40, a circuit being completed via the conductor 50 to one side of the circuit 84 when the contact ends **44*a* and 46*a* of the reeds 44 and 46 are closed. The other side of the circuit 84 is connected to the positive terminal 70 of the battery 68 via the conductor 80. Since closing of the normally open contacts 44*a*, 46*a* of the reed switch 40 is responsible for supplying battery power to the circuit 84, the reed switch also appears in FIG. 5. The reed switch 40 is closed only by being moved into the magnetic field provided by the embedded or concealed magnet 18 contained within the chest of the doll 12**.

The circuit 84 comprises two complementary transistors $Q_1$ and $Q_2$, the transistor $Q_1$ being an NPN type and the transistor $Q_2$ a PNP type. Also included in the circuit 84 is a voltage divider 88 formed by two resistors 90 and 92. The junction of the two resistors 90, 92 have connected thereto one plate of a capacitor 94, the other plate of the capacitor being connected to one end of a coil 96 having an iron core 98 therein.

Figure 4:
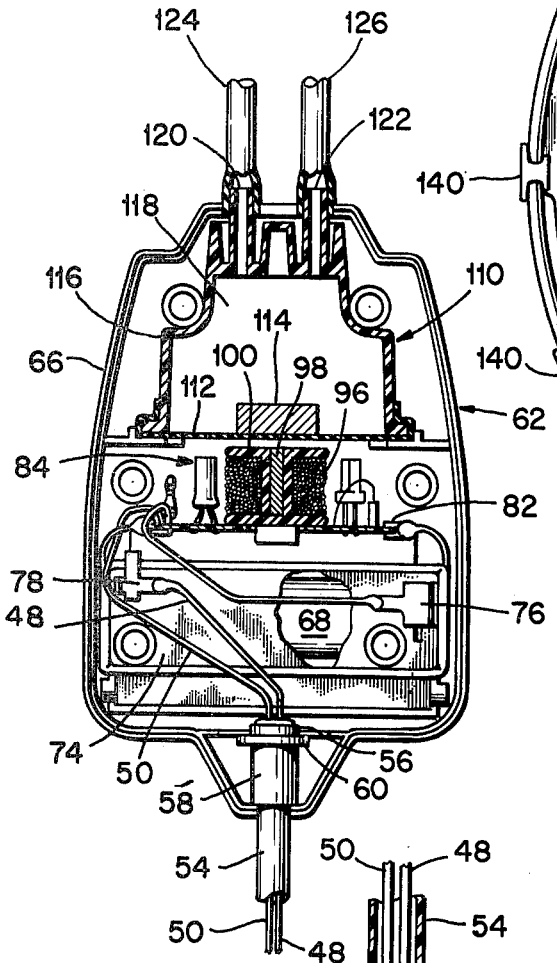
FIG. 4 is a sectional view taken in the plane of line **62*a* of FIG. 1 for the purpose of depicting the means by which the heartbeat-like sound is produced.

From FIG. 4, it will be seen that the coil 96 is wound on a spool 100 which is mounted on the printed circuit board 82. Performing a protective function is a diode 101, being connected across or in parallel with the coil 96; more specifically, it eliminates the likelihood of transistor $Q_2$ from breaking down due to induction surges when this transistor is turned off.

The base of the transistor $Q_1$ is also connected via a resistor 102 to the junction of the resistors 90 and 92, whereas its collector is connected directly to the base of the transistor $Q_2$. It will be seen that the end of the resistor 92 opposite the end joined to the resistor 90 is grounded at 86 and the end of the coil 96 remote from the capacitor 94 is similarly grounded. Also, the emitter of the transistor $Q_1$ is grounded at 86, these various grounds all being connected to the negative terminal 72 of the battery 68.

At this time attention is directed to a sound producing transducer 110 contained within the case 62. More specifically, the transducer 110 includes an elastomeric diaphragm 112, preferably thin rubber, having an armature in the form of a small permanent magnet 114 adhesively secured thereto. The diaphragm 112 is stretched over one end of a plastic sound box or chamber 116 having a void or space 118 therein.

Extending from the end of the plastic sound box 116 that is remote from the end having the diaphragm 112 thereon are two tubular nipples 120 and 122, the nipples 120, 122 passing through the end of the case 62 remote from the end through which the conductors 48, 50 enter. Attached to the projecting nipples 120, 122 are two plastic hearing tubes 124, 126. At the opposite ends of the hearing tubes 124, 126 are cone-shaped soft rubber earpieces 128, 130 which the user places in his or her ears as is apparent from FIG. 1.

Further included in the construction of the stethoscope 22 is a U-shaped plastic frame 132 composed of a pair of resilient or spring arms 134 and 136, the arms 134 and 136 being connected together at one end by means of an integral bridging portion 138. The resilient arms 134, 136 have a plurality of spaced tube holders 140 formed integrally thereon. The holders 140 releasably grip the hearing tubes 124, 126 as will be understood from FIG. 2.

Having presented the foregoing description, the manner in which our toy stethoscope 22 is used should be readily understood. However, in order to fully appreciate the benefits to be derived from a practicing of our invention, a brief operational sequence will be presented. Assuming that the girl 10 has placed the earpieces 128, 130 in her ears as illustrated in FIG. 1, she then picks up the probe 24, moving it over a random or exploratory path on the doll's skin 14. There is no visible clue as to where the magnet 18 is located, for the magnet 18 is concealed in the illustrative situation by the skin 14. However, an older person may have told her that it is placed where a human heart should be found. If the little girl 10 is quite small, an adult might very well perform the exploratory function first, letting the girl hear the simulated heartbeat so that she will then wish to relocate the proper position by herself.

At any rate, even after once shown, it is necessary that the pickup probe 24 be positioned in a proximal relationship with the concealed magnet 18. The magnet 18, it will be appreciated, is not a strong one and its field is quite localized. Consequently, it is necessary that the probe 24 be moved into close proximity with the magnet 18. When the reed switch 40 contained in the probe 24 is influenced by the magnetic field provided by the magnet 18, the reeds 24, 26 are deflected by the magnetic attraction so as to close the normally open contacts 44*a*, 46*a*. This completes an electrical path from the battery 68 to the circuit 84. The energization of the circuit 84, of course, is responsible for operating or actuating the sound producing transducer 110, doing so through the agency of the coil 96. Since the purpose of the transducer 110 is to provide a heartbeat-like sound, it is important that the coil 96 be repeatedly energized and de-energized at a rate corresponding to the thump, thump of a human or animal heart, as the case may be.

Describing now the operation of the circuit 84, it will be understood that when the switch 40 is closed by virtue of its proximity to the magnet 18, the circuit 84 will immediately be connected to the battery 68. An electrical path then exists from the positive terminal 70 of the battery 68 through the resistor 90 and the resistor 92 to ground 86. The right side of the capacitor 94 is grounded through the coil 96. Being discharged, the capacitor 94 begins to charge. Obviously, the time necessary for the capacitor 94 to become fully charged is determined by the RC constants of the circuit, namely the resistance of the resistors 90, 92 and the capacitance of the capacitor 94. The RC constants are chosen so as to simulate the human heartbeat, more specifically on the order of 50 to 70 times per minute.

When the capacitor 94 has been sufficiently charged so the potential at the junction of the resistors 90 and 92 exceeds the base-emitter voltage of transistor $Q_1$, transistor $Q_1$ begins to conduct. Its collector current passes directly into the base of the transistor $Q_2$ to cause transistor $Q_2$ to begin conducting, whereupon the upper end of the coil 96 is pulled toward the potential of the positive battery terminal 70 because of the lowered impedance of the now conducting transistor $Q_2$. As soon as this happens, the left side of the capacitor 94 is pulled up, saturating transistors $Q_1$ and $Q_2$, thereby energizing the coil 96. The capacitor 94 now discharges into the base of the transistor $Q_1$, and when the current into the base of transistor $Q_1$ is insufficient to turn on transistor $Q_1$, both transistors $Q_1$ and $Q_2$ turn off, returning the upper end of the coil 96 to ground potential. The left side of the capacitor is brought to below ground potential and the recharging cycle commences again through the resistors 90 and 92.

Recapitulating, it is the movement of air caused by the attraction (when the coil 96 is energized) of the armature or magnet 114 that produces one thumping sound by reason of the movement of air within the chamber or sound box 116, and the return of the magnet 114 (when the coil 96 is deenergized) which produces the second simulated heartbeat. It will be recognized that human heartbeats are of a dual character, there being one heartbeat followed by a second within a shorter interval of time, and the circuit 84 effectively simulates this happening.

Because the child 10 must move the probe 26, and the reed switch 40 contained therein, to a location in the vicinity of where the magnet 18 is hidden, the invention is endowed with a true learning experience for the child. Even where a child is too young to appreciate the educational benefit to be derived, he or she still hears the heartbeat-like sound at only the times when the movement has resulted in the needed registry of the probe 26 with the magnet 18.

Consequently, our invention proves intriguing, entertaining and educational to various age groups.

We claim:

1. Play apparatus comprising a baby doll having a layer of plastic skin and a permanent magnet retained against the inner side of said skin in the region of the doll's chest and at a location approximately where a baby's heart should be, and a toy stethoscope including a pair of flexible hearing tubes, each having an earpiece at one end thereof, a sound producing chamber connected to the other ends of said hearing tubes, a flexible diaphragm covering a portion of said chamber, an armature element mounted on said diaphragm, a coil for attracting said armature element when energized so as to deflect said diaphragm from its normal or undeflected condition, circuit means for energizing said coil to cause said attraction, a battery for supplying power to said circuit means, a pair of conductors for connecting said battery to said circuit means, an additional flexible tube having one end into which said conductors extend, a probe housing connected to the other end of said additional tube, and a magnetically responsive reed switch contained in said probe housing, said reed switch having a pair of normally open contacts, whereby when said probe and the reed switch contained therein are juxtaposed with respect to said magnet, said magnet will cause said open contacts to close and complete an electrical path via said conductors to said circuit means to cause energization of said coil and movement of said armature element with a concomitant flexing of said diaphragm to produce a heartbeat-like sould.

2. Play apparatus in accordance with claim 1 in which said circuit means alternately energizes and deenergizes said coil.

3. Play apparatus in accordance with claim 2 in which said circuit means comprises a multivibrator.

4. Play apparatus in accordance with claim 3 in which said armature element constitutes a second magnet.

5. Play apparatus comprising an animate-like figure having a layer of artificial skin and a permanent magnet retained against the inner side of said skin, and a toy stethoscope including a pair of flexible hearing tubes, each having an earpiece at one end thereof, a case at the other ends of said tubes, electrically operated sound producing means within said case and connected to the other ends of said hearing tubes, whereby sound from said sound-producing means travels via said tubes to said earpieces, circuit means for operating said sound producing means, a battery in said case for supplying power to said circuit means, a pair of conductors for connecting said battery to said circuit means, a magnetically responsive reed switch, said reed switch having a pair of normally open contacts, a probe housing, said magnetically responsive reed switch being contained in said probe housing, and an additional flexible tube connected to said case at one end and connected to said probe housing at its other end, said pair of conductors passing through said additional flexible tube, whereby when said probe and the reed switch contained therein are juxtaposed with respect to said magnet, said magnet will cause said open contacts to close and complete an electrical path via said conductors to said circuit means to cause operation of said sound producing means to produce a heartbeat-like sound.

* * * * *